US009072421B2

(12) United States Patent
Park et al.

(10) Patent No.: US 9,072,421 B2
(45) Date of Patent: Jul. 7, 2015

(54) DISHWASHER

(75) Inventors: Nung Seo Park, Seoul (KR); Sang Heon Yoon, Gwangmyung-si (KR); Yong Jin Choi, Daegoo-si (KR); Dae Yeong Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 2255 days.

(21) Appl. No.: 11/515,391

(22) Filed: Sep. 5, 2006

(65) Prior Publication Data

US 2007/0079851 A1 Apr. 12, 2007

(30) Foreign Application Priority Data

Sep. 5, 2005 (KR) ..... 10-2005-0082066

(51) Int. Cl.
*A47L 15/42* (2006.01)

(52) U.S. Cl.
CPC ..... *A47L 15/4234* (2013.01); *A47L 15/4204* (2013.01); *A47L 15/4208* (2013.01); *A47L 15/4236* (2013.01); *A47L 15/4285* (2013.01); *A47L 2601/04* (2013.01)

(58) Field of Classification Search
CPC ..... A47L 15/4234
See application file for complete search history.

(56) References Cited

U.S. PATENT DOCUMENTS

| | | | | | |
|---|---|---|---|---|---|
| 2,277,291 | A | * | 3/1942 | Blair | 392/397 |
| 4,135,531 | A | | 1/1979 | Federighi et al. | |

FOREIGN PATENT DOCUMENTS

| | | | | | |
|---|---|---|---|---|---|
| CN | 2614624 | | | 5/2004 | |
| EP | 0299343 | | * | 1/1989 | A47L 15/42 |
| EP | 0593876 | | * | 4/1996 | A47L 15/00 |
| JP | 02-082930 | | | 3/1990 | |
| JP | 2001-054497 | A | * | 8/1999 | A47L 15/42 |
| WO | WO2004/058035 | | * | 7/2004 | A47L 15/42 |
| WO | WO 2004/058035 | A1 | | 7/2004 | |

* cited by examiner

*Primary Examiner* — Michael Barr
*Assistant Examiner* — Jason Riggleman
(74) *Attorney, Agent, or Firm* — McKenna Long Aldridge LLP

(57) ABSTRACT

There is provided a dishwasher. The dishwasher includes a tub for receiving dishes, a steam generation unit provided at an outside of the tub and generating steam that will be supplied to the tub, a steam passage along which the steam generated from the steam generation unit is supplied to the tub, and a chamber for storing water used for generating the steam.

4 Claims, 4 Drawing Sheets

DISHWASHER

This application claims the benefit of Korean Patent Application No. 10-2005-0082066, filed on Sep. 5, 2005, which is hereby incorporated by reference for all purposes as if fully set forth herein.

BACKGROUND OF THE INVENTION

1. Field of the Invention

The present invention relates to a dishwasher, and more particularly, to a dishwasher having a steam generation unit for improving the washing performance.

2. Description of the Related Art

Generally, a dishwasher is a machine that washes and dries dishes by spraying pressurized washing water through spraying nozzles.

A typical dishwasher includes a tub defining an outer appearance of the dishwasher and a sump mounted on a floor of the tub to reserve the washing water. By the pumping operation of the washing pump mounted in the sump, the washing water is directed to the spraying nozzle and sprayed under high pressure through spraying holes formed on the spraying nozzle. The sprayed washing water collides with a surface of the dish to remove foreign objects such as food wastes adhered to the dishes. The food wastes removed from the dishes are reserved on a floor of the tub.

In order to improve the washing performance of the dishwasher, a heater is installed in the sump. When the heat is operated, the washing water is heated and sprayed into the washing tub through the spraying nozzle. By the heated washing water, the food wastes can be more effective removed from the dishes.

However, when the washing water stored in the sump is heated, the foreign objects and detergent contained in the washing water may be heated together. This causes the emission of an offensive odor. In addition, the foreign objects may be adhered to the heater. In this case, the service life of the heater may be reduced.

In addition, when a large amount of water stored in the sump is heated, the time for heating the water increase. This causes the increase of the power consumption and the energy loss.

Furthermore, when grains of boiled rice that is a staple food for most of Asia countries are adhered to the dishes, they are not easily removed from the dishes even when the heated washing water is sprayed to the dishes.

SUMMARY OF THE INVENTION

Accordingly, the present invention is directed to a dishwasher that substantially obviates one or more problems due to limitations and disadvantages of the related art.

An object of the present invention is to provide a dishwasher, which can supply steam into a tub to effectively remove food waste from dishes.

Another object of the present invention is to provide a dishwasher, which can quickly generate steam and control an amount of the steam according to an amount of dishes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher including: a tub for receiving dishes; a steam generation unit provided at an outside of the tub and generating steam that will be supplied to the tub; a steam passage along which the steam generated from the steam generation unit is supplied to the tub; and a chamber for storing water used for generating the steam.

In another aspect of the present invention, there is provided a dishwasher including: a tub; a steam generation unit provided at an outside of the tub and generating steam that will be supplied to the tub; a chamber for storing water that will be supplied to the steam generation unit; a water supply passage along which water is supplied from an external water source to the chamber; a supply passage along which the water stored in the chamber is supplied to the steam generation unit; and a steam passage along which the steam generated from the steam generation unit is supplied to the tub.

In still another aspect of the present invention, there is provided a dishwasher including: a washing chamber; a steam generation unit generating steam for washing dishes loaded in the washing chamber; a steam passage along which the steam generated from the steam generation unit is supplied to the washing chamber; a chamber for storing water used for generating the steam; and a flow control unit for controlling an amount of the water being supplied to the steam generation unit.

According to the present invention, since the food waste adhered to the dishes sucks moisture form the high temperature steam, the food waste adhered to the dishes can be easily removed from the dishes. Furthermore, the high temperature steam can provide an effect of sterilizing the dishes.

In addition, since the amount of the water supplied to the steam generation unit can be controlled, the amount of the steam generated from the steam generation unit can be controlled according to the amount of the dishes.

Furthermore, since the food waste adhered to the dishes can be easily removed, the washing time for washing the dishes can be reduced and the washing performance can be improved.

In addition, since the chamber maintains the predetermined water level, the water can be stably supplied to the steam generation unit regardless of the external water supply condition.

Furthermore, since the water supply control valve is provided on the supply passage, an amount of water directed to the chamber 210 can be controlled.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
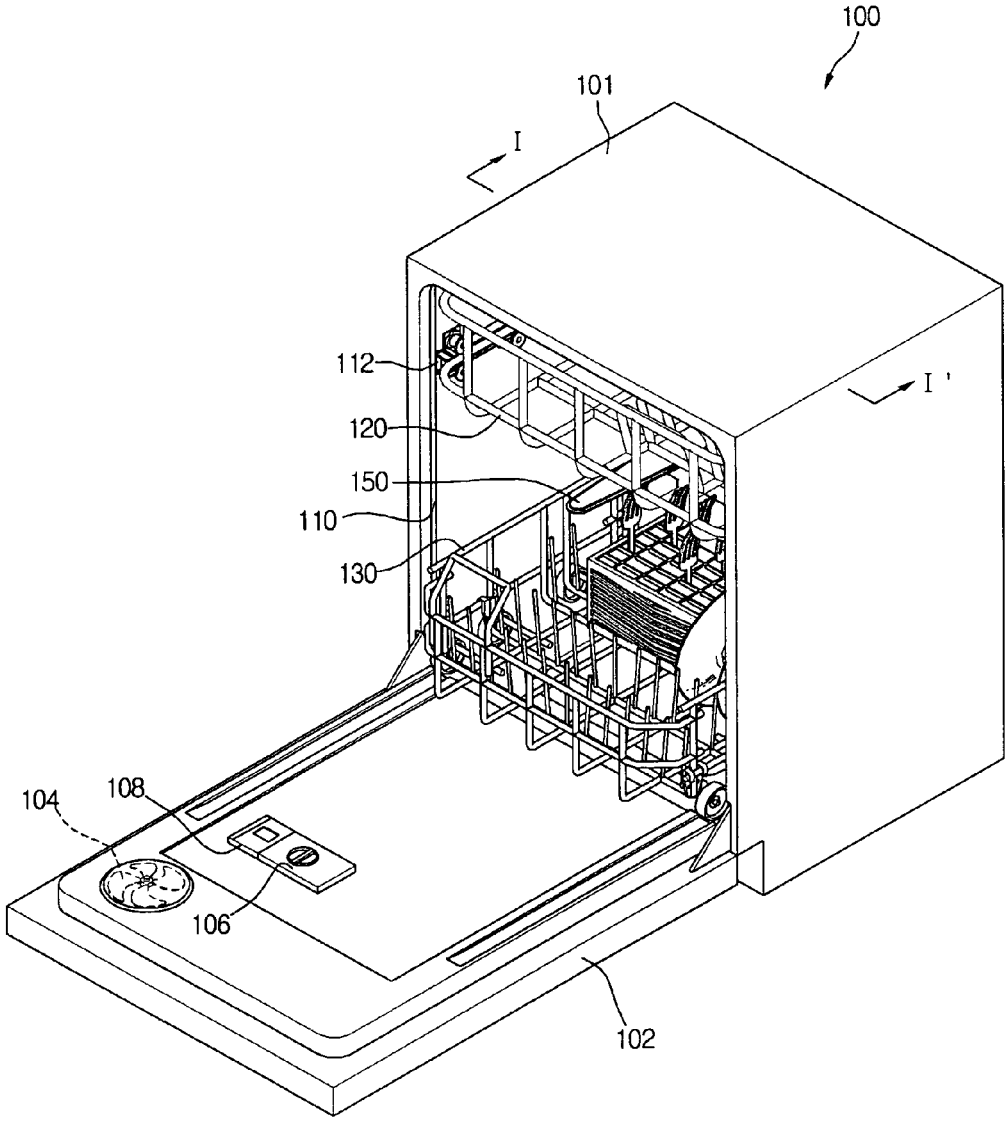
FIG. 1 is a perspective view of a dishwasher according to an embodiment of the present invention.

FIG. 1 is a sectional view of a dishwasher having a sump mounting structure according to an embodiment of the present invention.

Referring to FIG. 1, a dishwasher 100 includes a case 101 defining an outer appearance of the dishwasher 100 and having a front portion provided with an opening and a door 102 for opening and closing the opening formed on the front portion of the case 101.

Provided in the tub 110 are upper and lower racks 120 and 130 in which dishes can be loaded and which can be drawn out of the tub 110, upper, lower and top nozzles 150, 160 and 155 for spraying washing water toward the upper and lower racks 120 and 130. The upper and top nozzles 150 and 155 are connected to a water guide 140 (see FIG. 2) to receive washing water from the water guide 140.

A rail 112 is formed on an inner surface of the tub 110 to support the sliding the upper rack 120 frontward or rearward.

A lower end of the door 102 is coupled to the case 101 by a hinge (not shown) so as to pivot around the hinge in a vertical direction. An exhaust fan 104 is installed on the door 102 to forcedly exhaust internal air of the tub 110 to an external side.

A rinse container 106 for supplying rinse during the washing operation is provided on an inner surface of the door 102. A detergent container 108 for dispensing detergent by a fixed quantity is provided on the inner surface of the door at a side of the rinse container 106. During the operation of the dishwasher 100, a fixed quality of detergent is dispensed from the detergent container 108.

Figure 2:
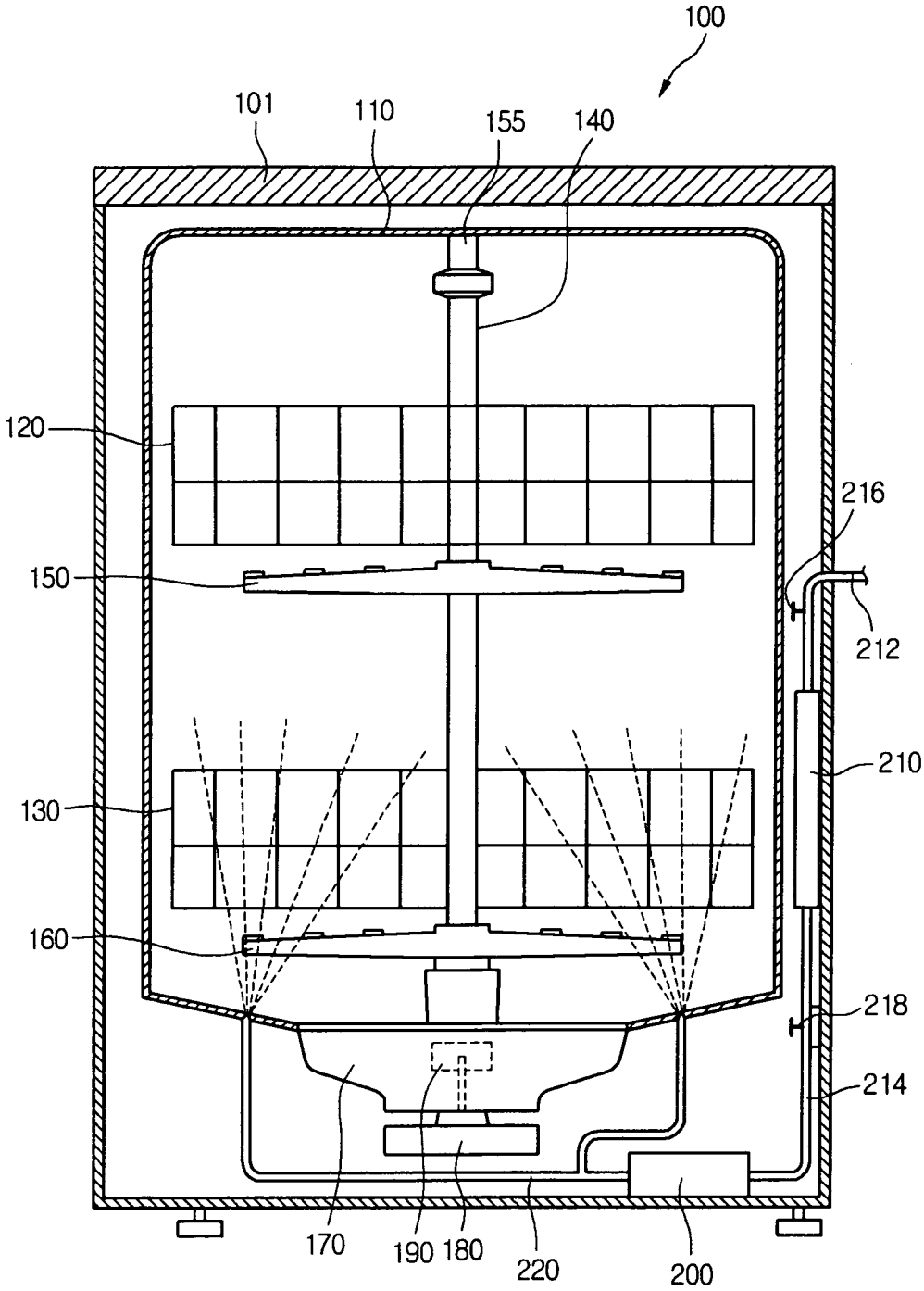
FIG. 2 is a sectional view taken along line I-I' of FIG. 1.

FIG. 2 is a sectional view taken along line I-I'.

Referring to FIG. 2, the dishwasher 100 of this embodiment includes the tub 110, the sump 170 installed on a floor of the tub 110 to pump washing water, and the water guide 140 along which washing water pumped by the sump 170 flows. The dishwasher 100 further includes a washing pump 190 for pumping the washing water stored in the sump 170 and a washing motor 180 connected to a rotational shaft of the washing pump 190 to drive the washing pump 190.

In addition, the dishwasher 100 further includes a steam generation unit 200 disposed under the tub 110 to generate steam, a chamber 210 provided near the tub 110 to store the water that will be supplied to the steam generation unit 200, and a steam passage 220 along which the steam generated from the steam generation unit 200 is directed into the tub 110.

In addition, the dishwasher 100 further includes a water supply passage 212 for supplying the water to the chamber 210 and a supply passage 214 for supplying the water from the chamber 210 to the steam generation unit 200.

A plurality branch passages are branched from the steam passage 220 so that the steam can be exhausted into at least a portion of the tub 110. That is, an extreme end portion of the steam passage 220 may be provided on a side and/or upper and lower portion of the tub 110.

Therefore, the steam can spread in all directions in the tub 110.

Herein, in order for the steam to spread away in the distance, a spraying nozzle (not shown) may be provided on an end of the steam passage 220 or the extreme end portion of the steam passage 220 is reduced in a diameter so that the extreme end functions as a spraying nozzle.

In addition, a water supply control valve 216 is provided on the supply passage 212 to control an amount of water directed to the chamber 210. Here, the water supply control valve 216 can control the opening/closing time so that the water level of the chamber 210 can be constantly maintained.

A flow control unit 218 for controlling an amount of water directed to the steam generation unit 200 is provided on the supply passage 214. That is, since the water supplied from the supply passage 214 is phase-changed into steam while passing through the steam generation unit 200, the flow control unit 218 controls the flow of the water such that a relatively small amount of water can be supplied to the steam generation unit 200.

Furthermore, when the flow control unit 218 may be a micro pump or a valve that can precisely control the flow of the water. As the valve may be a solenoid valve that is turned on or off according to an application of the electric current. Like the water supply control valve 216, the flow control unit 218 may be also controlled in its operation time.

Meanwhile, the chamber 210 stores the water that will be supplied to the steam generation unit 210. An amount of the water stored in the chamber 210 can be uniformly maintained by the water supply control valve 216 and the flow control unit 218. That is, when the water stored in the chamber 210 is exhausted by the flow control unit 218, water is newly supplied into the chamber 210 as much as the water exhausted so that the chamber 210 can maintain a predetermined water level.

Therefore, since the chamber 210 maintains the predetermined water level, the water can be stably supplied to the steam generation unit 200 regardless of the external water supply condition.

Figure 3:
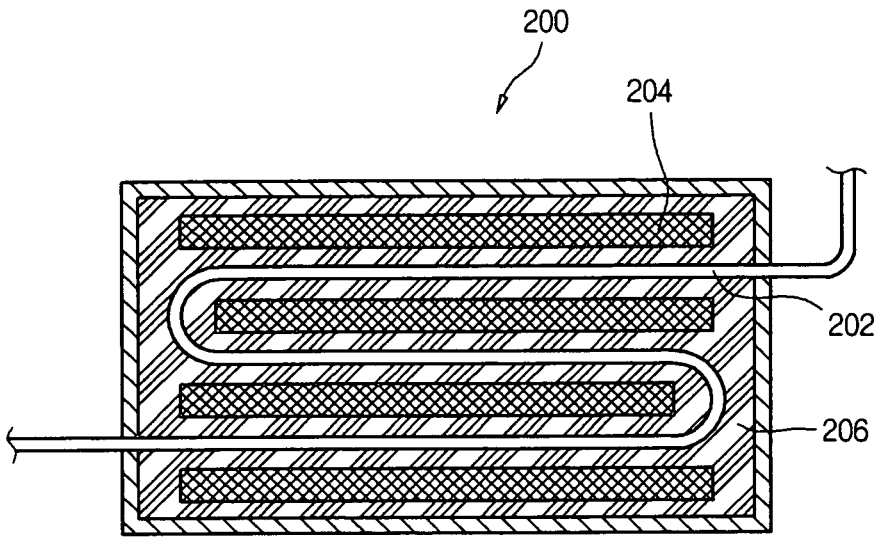
FIG. 3 is a sectional view of a steam generation unit according to an embodiment of the present invention.

FIG. 3 is a sectional view of the steam generation unit.

Referring to FIG. 3, the steam generation unit 200 generates steam by heating the water flowing an internal water passage formed therein.

That is, the steam generation unit 200 includes a heating tube having a first end connected to the supply passage 214 and a second end connected to the steam passage 220, a heater 204 disposed near the heating tube 202 to transmit heat to the heating tube 202, and a heat conductive unit 206 provided around the heat 204 and the heating tube 202 so that the heat of the heater 204 can be quickly transmitted to the heating tube 202.

The heater 204 may be a sheath heater. The heat conductive unit 206 functions as a heat transmission medium for transmitting the heat generated by the heater 204 to the heating tube 202. The heat conductive unit 206 may be formed of a high heat-conductive material.

Furthermore, the heating tube 202 is disposed in the steam generation unit 200 and has a plurality bending portions so as to increase the length of the flow path of the water directed into the steam generation unit 200. Therefore, a heat contact area of the heating tube 202 increases and thus a large amount of heat can be transmitted from the heater 204 to the heating tube 202. As a result, the steam can be quickly generated.

As described above, since the amount of the water directed to the heating tube 202 can be controlled by the flow control unit 218, the steam can be generated upon supplying the water to the heat tube 202.

The heater 204 may be provided by a plurality. An amount of heat generated by the heaters 204 can be controlled by controlling electric power applied to the heaters 204. The amount of the steam generated can be controlled by the flow control unit 218. That is, when a relatively large amount of the dishes are loaded in the dishwasher, the flow control unit 218 supplies a relatively large amount of water to the steam generation unit 200 so that a relatively large amount steam can be supplied into the tub.

The operation of the above-described dishwasher 100 will now be described.

The operation of the dishwasher 10 will be now described.

The door 102 is first opened and the upper rack 120 and/or lower rack 130 are withdrawn out of the dishwasher 10. The dishes are arranged on the racks 120 and 130. Then, the racks 120 and 130 are returned to their initial positions and the door 102 is closed. The electric power is applied to operate the dishwasher.

Meanwhile, when the electric power is applied, the washing water is supplied into the sump 170. After a predetermined amount of the washing water is supplied into the sump 170, the washing motor 180 operates. At this point, an impeller (not shown) provided in the washing pump 190 connected to a motor shaft of the washing motor 180 rotates to pump the washing water to the lower nozzle 160 and the water guide 140.

The washing water pumped out to the water guide 140 is sprayed into the washing chamber via the top and upper nozzles 155 and 150.

The washing water sprayed downward from the top nozzle 155 and the washing water sprayed upward from the upper nozzle 150 wash the dishes loaded on the upper rack 120.

The washing water sprayed upward from the lower nozzle 160 washes the dishes loaded on the lower rack 139. By forming spraying holes on a bottom of the upper nozzle 150, the upper nozzle 150 may simultaneously spray the washing water upward and downward to wash both surfaces of the dishes.

The used washing water is collected in the sump 170 and the foreign objects contained in the used washing water are filtered off by a filter (not shown) provided in the sump 170. The used washing water whose foreign objects are filtered off ix drained through a drain pump (not shown).

In addition, when the used washing water is drained, clean rinsing water is supplied to the sump 170 through a washing water inlet and sprayed through the nozzles 150 and 160 to perform a rinsing process.

When the rinsing process is finished, a drying process is performed to complete the whole washing process.

During the above-described washing process, steam is generated from the steam generation unit 200 and supplied into the tub 110.

That is, the water stored in the chamber 210 is exhausted by the flow control unit 218. The exhausted water is directed into the steam generation unit 200 through the supply passage 214. At this point, the flow control unit 218 can control the amount of the water according to the amount of the dishes loaded in the tub 110.

In addition, simultaneously with the exhaustion of the chamber 210, electric power is applied to the heater 204 so that the heater 204 can generate heat. When the water is exhausted from the chamber 210 by the flow control unit 218, the water supply control valve 216 is opened to supply water from an external side to the chamber 210 as much as the water exhausted from the chamber 210. Therefore, the water can be stably supplied to the steam generation unit 200 regardless of the external water supply condition.

Next, the water supplied to the steam generation unit 200 is heated by the heater 204 while flowing along the heating tube 202. Then, the water flowing along the heating tube 202 is phase-changed into the steam. The steam is supplied into the tub 110 through the steam passage 220. Here, since the steam passage 220 is branched off, the steam is supplied in all directions in the tub 110.

Therefore, as the steam is supplied into the tub 110, the food waste adhered to the dishes can be effective removed from the dishes. That is, the food waste adhered to the dishes sucks moisture form the high temperature steam supplied and thus is easily removed from the dishes. Furthermore, the high temperature steam can provide an effect of sterilizing the dishes.

In addition, since the amount of the water supplied to the steam generation unit can be controlled, the amount of the steam generated from the steam generation unit can be controlled according to the amount of the dishes.

Furthermore, since the food waste adhered to the dishes can be easily removed, the washing time for washing the dishes can be reduced and the washing performance can be improved.

Figure 4:
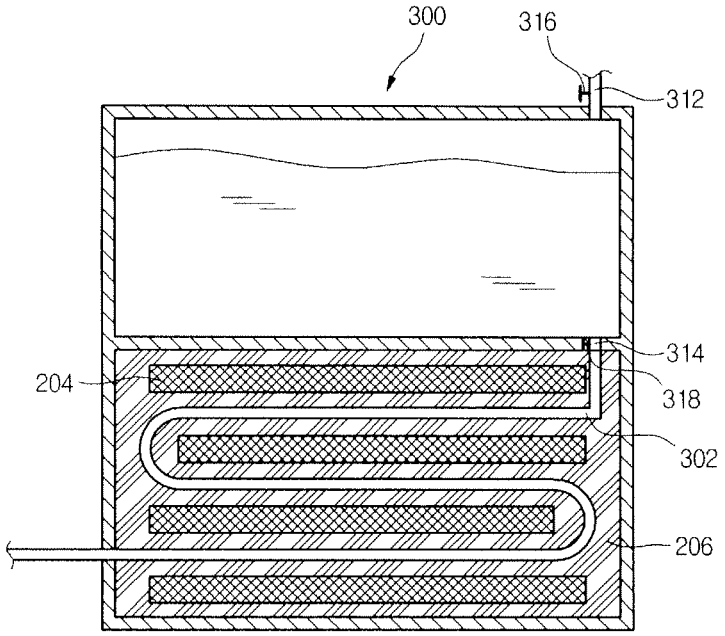
FIG. 4 is a sectional view of a steam generation unit in accordance with yet another embodiment of the present invention.

FIG. 4 is a sectional view of a steam generation unit according to another embodiment of the present invention.

Referring to FIG. 4, a chamber 310 for storing water that will be used for generating steam is formed in the steam generation unit 300.

That is, the chamber 310 is positioned at an upper side of the steam generation unit 300. A water supply passage 312 for supplying water from an external side to the chamber 310 is connected to an upper portion of the steam generation unit 300. A water supply control valve 316 for controlling an amount of the water being supplied to the chamber 300 is provided on the water supply passage 312.

The steam generation unit 300 a heat tube 302 having a first end connected to the supply passage 214 and a second end connected to the steam passage 320, a heater 304 disposed near the heating tube 302 to transmit heat to the heating tube 302, and a heat conduction unit 306 provided around the heater 304 and the heating tube 202 to quickly transmit the heat generated from the heater 304 to the heating tube 302.

The heating tube 302 and the chamber 310 are interconnected by the supply passage 314. A flow control unit 318 is provided on the supply passage 314 to control an amount of the water being supplied to the heating tube 302. The flow control unit 318 may be a micro pump or a valve.

According to this embodiment, since the chamber 310 is formed in the steam generation unit, a space taken by the chamber 310 can be reduced, thereby improving the space efficiency and effectively transmitting the heat generated from the heater 304 to the water stored in the chamber 310. As a result, the water stored in the chamber 310 can be preheated. When the pre-heated water is directed into the heating tube 302, the steam can be more quickly generated.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a washing chamber;

a steam generation unit for generating steam to wash dishes loaded in the washing chamber; and a steam passage along which the steam generated from the steam generation unit is supplied to the washing chamber;

wherein the steam generation unit comprises a body, a barrier divides an internal space of the body into a storage chamber for storing water used for generating the steam and a heating chamber for heating the water supplied from the storage chamber;

a supply passage along which the water stored in the storage chamber is supplied to the heating chamber;

a flow control unit for controlling an amount of the water being supplied to the heating chamber; and a heating tube disposed in the heating chamber and fluidly connected to the supply passage in which water can flow;

a heater disposed in the heating chamber for heating the water flowing through the heating tube, wherein the heater is proximate to the heating tube.

2. The dishwasher according to claim 1, further comprising a water supply passage along which the water is supplied from an external water source to the storage chamber and a water supply control valve for controlling an amount of the water being supplied to the storage chamber.

3. The dishwasher according to claim 1, wherein an amount of the water being supplied to the heating chamber is same as that of the water being supplied to the storage chamber through the water supply passage.

4. The dishwasher according to claim 1, wherein the steam generating unit further comprises a heat conductive unit provided around the heater and the heating tube so that the heat of the heater can be quickly transmitted to the heating tube.

* * * * *